United States Patent [19]

Zigmont

[11] 4,192,024

[45] Mar. 11, 1980

[54] SPA LOUNGE

[76] Inventor: Clifford V. Zigmont, 18642 Community St., Northridge, Calif. 91324

[21] Appl. No.: 954,994

[22] Filed: Oct. 26, 1978

Related U.S. Application Data

[63] Continuation-in-part of Ser. No. 646,149, Jan. 2, 1976, abandoned.

[51] Int. Cl.[2] ..... E04H 3/16; E04H 3/18

[52] U.S. Cl. ..... 4/172; 4/185 AB; 4/185 S; 5/120; 5/122; 128/369

[58] Field of Search ..... 4/172, 177, 177 CW, 4/185 L, 185 S, 172.19, 172.12, 172.11; 5/81 R, 120, 122; 128/369, 66

[56] References Cited

U.S. PATENT DOCUMENTS

| | | | |
|---|---|---|---|
| 22,733 | 1/1859 | Karshner | 128/369 |
| 362,969 | 5/1887 | Jacobus | 4/185 S |
| 743,025 | 11/1903 | Von Orth | 128/369 |
| 1,059,314 | 4/1913 | Petter | 4/160 |
| 1,589,824 | 6/1926 | Specht | 5/122 |
| 1,814,579 | 7/1931 | Ames | 5/122 |
| 1,917,518 | 7/1933 | Goudie | 5/120 |
| 2,827,949 | 3/1958 | Kershaw | 5/120 X |
| 3,110,908 | 11/1963 | Newgard | 4/172.12 |
| 3,229,309 | 1/1966 | Knodel | 4/172.12 |
| 3,366,977 | 2/1968 | Koehler | 4/172.12 |
| 3,595,224 | 7/1971 | Walter | 4/185 AB |
| 3,781,925 | 1/1974 | Curtis et al. | 4/172.15 |
| 3,837,019 | 9/1974 | Hoff | 5/120 |
| 3,857,118 | 12/1974 | Mano et al. | 4/185 L |
| 4,001,899 | 1/1977 | Mathis | 4/172 |

FOREIGN PATENT DOCUMENTS

| | | | |
|---|---|---|---|
| 148994 | 8/1902 | Fed. Rep. of Germany | 4/185 AB |
| 449466 | 9/1927 | Fed. Rep. of Germany | 4/185 B |
| 50490 | 1/1911 | Switzerland | 4/185 S |

*Primary Examiner*—Henry K. Artis
*Attorney, Agent, or Firm*—Sanford Astor

[57] ABSTRACT

This invention relates to a lounge to be used specifically in connection with a hot water spa, in which the lounge is constructed of water resistant materials and is constructed out of strips of material leaving large spaces in between the strips for the bubbling and circulating hot water to reach the individual who is lying in the lounge. The lounge is attached to the spa by a strap fixed to the lounge, the strap having eyelets, and the other end of the strap fixed to a bolt which is slidably received in a sleeve located vertically in the ground adjacent opposite ends of the spa.

7 Claims, 5 Drawing Figures

SPA LOUNGE

This application is a continuation-in-part of my copending application, Ser. No. 646,149 filed Jan. 2, 1976, now abandoned.

BACKGROUND OF THE INVENTION

In recent years the most popular development in the field of personal comfort both in the home and in clubs, public facilities and private health clubs is the building and use of hot water spas sometimes called jacuzzi's. These hot water spas are often built in connection with a swimming pool being intalled in a persons back yard or in a public or private facility. They may be attached as a part of the swimming pool itself separated from the pool by a wall or they may be an entirely separate structure placed somewhere near or along the side of the pool. On the other hand many people have installed hot water spas without having a swimming pool at all because of extremely beneficial effects of the bubbling hot water. These hot water spas are commonly known and come in many shapes and sizes, most common of which are round and rectangular, Most of these spas simply have seats made of tile which jut out part way down the side wall around the entire circumference of the spa. These seats are a straight horizontal shelf which goes to the straight vertical wall. Other spas which may be purchased have internal plastic arrangements which include a contour type seat which still has a vertical back wall but a slightly grooved seat so that the person using it sits more comfortably within the spa.

These spas may be built where the water is introduced to the spa by jets which may be in the sides of the spa, and in addition may also come from the bottom of the spa, in which the hot water is forced into the spa at high pressure causing a rapid bubbling action of the water. This bubbling action is responsible for the theraputic nature of the spa itself, in the rapid action of the water, which is extremely relaxing and good for tired muscles and various injuries. Some of the spas now being built also have an air bubbling action in which many small holes are located either in the sides or the base of the seats of the spa in which air is also bubbled into the spa creating additional bubbling and turbulence in the water.

None of the spas built to date however have any arrangement so that the person using the spa may lie down in a reclining position. By lying down in a reclining position much more of the body is exposed to the bubbling and turbulent action of the hot water.

OBJECTS OF THE INVENTION

It is an object of the present invention to provide a device to be used in connection with hot water spas which allows the user to lie down in a reclining position.

It is a further object of the present invention to provide a device whereby the user may recline or lie down in a hot water spa and expose a major portion of his body to the hot, direct turbulence and bubbling action of the hot water.

Yet a further object of the invention is to provide a device which will support a human being in a reclining position in a hot water spa while at the same time exposing a major portion of his body to the hot water bubbling action of the spa.

These and other objects will become apparent from the following description and drawings in which.

Figure 1:
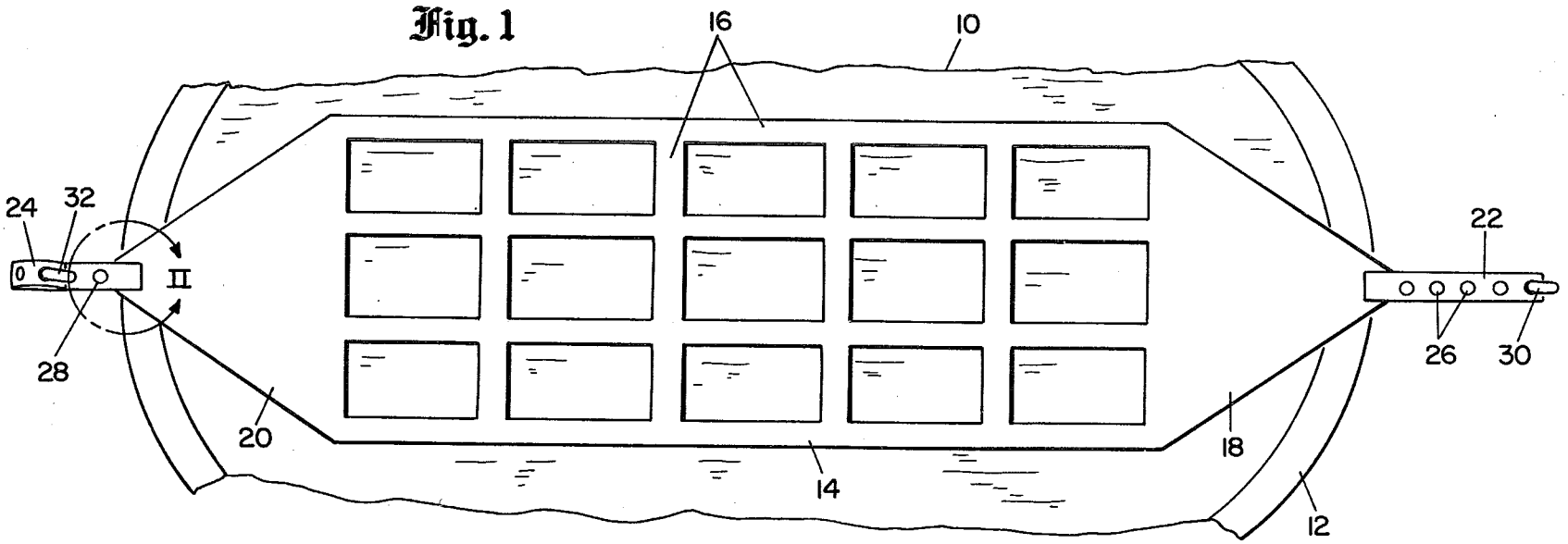
FIG. 1 is a plan view of the device of the present invention in a spa.

Referring now to FIG. 1 there is shown a hot water spa 10 having side walls 12 which are made out of concrete and may be faced with tile if desired as is common in the art relating to spas and swimming pools. Stretched across the diameter of the spa 10 is a lounge 14 which is made up of strips of water resistant material 16 which are interlaced in a rectangular manner to form a checkered pattern. There is a series of longitudinal narrow strips which are crossed by transverse strips to form the checkered pattern. These strips are very narrow in width causing large spaces to occur between the cross-hatched pattern formed by the narrow strips. The strips are made of any convenient water resistant material such as vinyl plastic. Because of the rapid bubbling and turbulence in the water within the spa and particularily because of the common use of water jets which are coming in a upward direction from the bottom of the spa, very little support is necessary for the body of a human being lying in the lounge. Therefore, the strips may be made from very narrow vinyl material with very large spaces in between, because the lounge itself needs provide only very slight body support for the person using the lounge.

The longitudinal and transverse strips may be unitarily formed or formed by simply sewing them together with nylon thread or any other convenient means to fixedly attach the strips in the shape shown. At the opposite ends of the longitudinal strips are the head rest portions 18 and 20 are solid material rather than strips as this provides a solid head rest while lying on the lounge 14. Attached to the head rest portions 18 and 20 are connecting straps 22 and 24 which contain eyelets 26 and 28. Attached to the staps 22 and 24 is a rod 30, 32 which is securely attached into the ground thus supporting the lounge 14 at either end. This will be more fully described in later figures.

Figure 2:
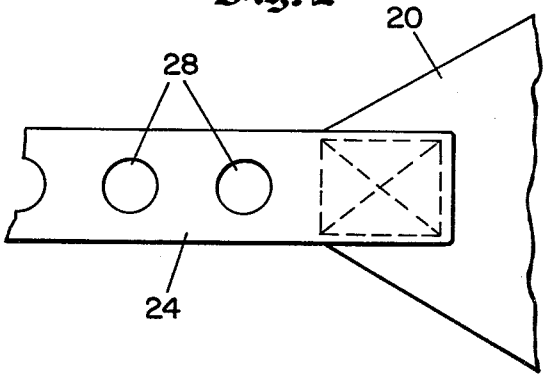
FIG. 2 is a closeup view of the strap attachment portion of the present invention.
Figure 3:
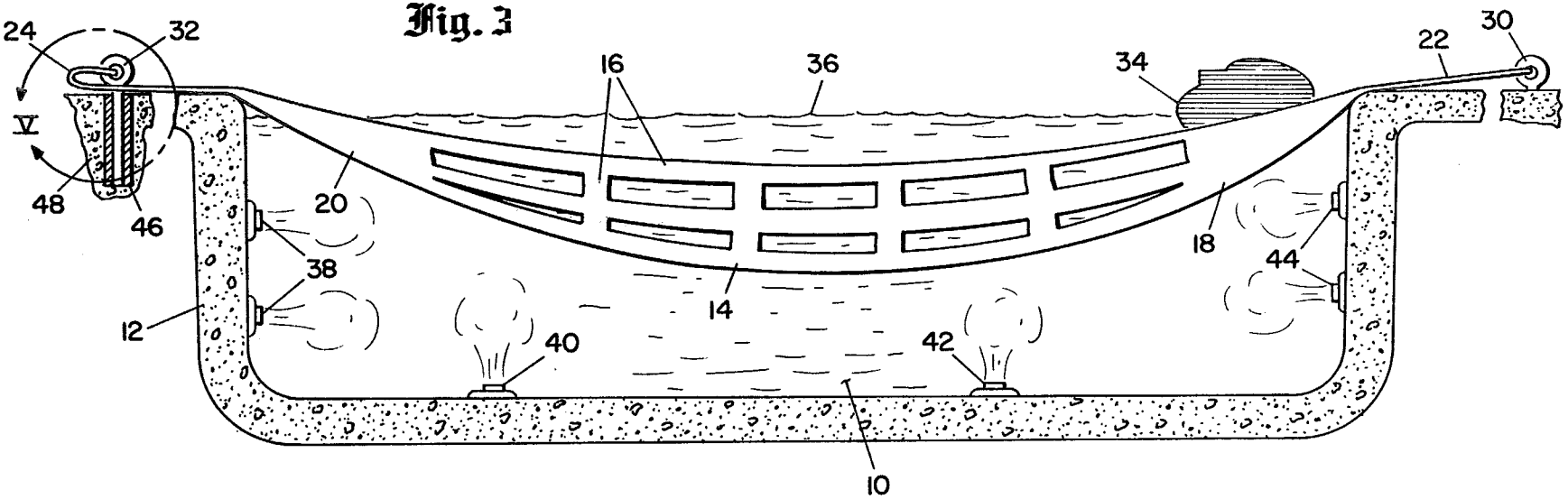
FIG. 3 is a side elevation view of the device of the present invention in a spa.

Referring to FIG. 2 there is shown the connecting strap 24 to which is fixedly attached the head rest 20. The straps are most conveniently fixedly connected to the head rest 20 by sewing onto the head rest with nylon thread (FIG. 2) or formed as unitary portions of the lounge 14 (FIG. 3). The strap 24 has eyelets for size adjustment which will be later explained.

Referring now to FIG. 3 there is shown the spa 10 with supporting walls 12 in which the lounge 14 is supporting a person 34. The longitudinal and vertical strips 16 are shown in a slightly sagging position below the top water level 36 in the spa so that the person's body is totally submerged within the spa 10 while the person's head is held out of the water by the head rests 18 or 20.

Shown inside of the spa are water jets 38, 40, 42 and 44 through which incoming hot water is swirled into the hot water spa 10.

The connecting straps 22 and 24 are attached to head rests 18 and 20. The straps 22 and 24 are then attached to bolts 30 and 32 which are slidably received in a hole 46 drilled into the concrete decking 48 or whatever other material is present in the ground surrounding the spa. The bolts 30 and 32 with the straps 22 and 24 fixedly attached support the lounge 14.

Figure 5:
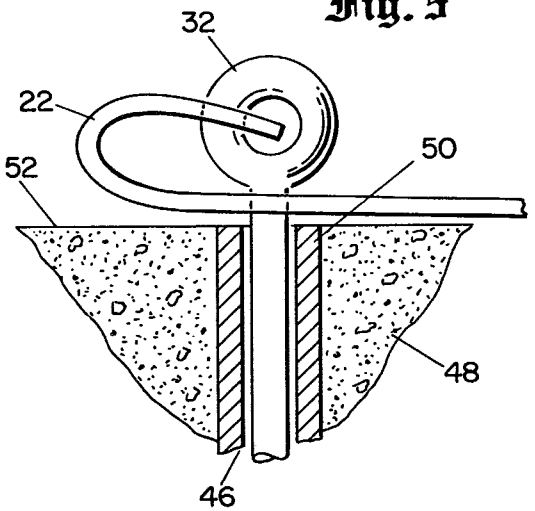
FIG. 5 is a closeup view of the ground attachment used in the present invention.
Figure 4:
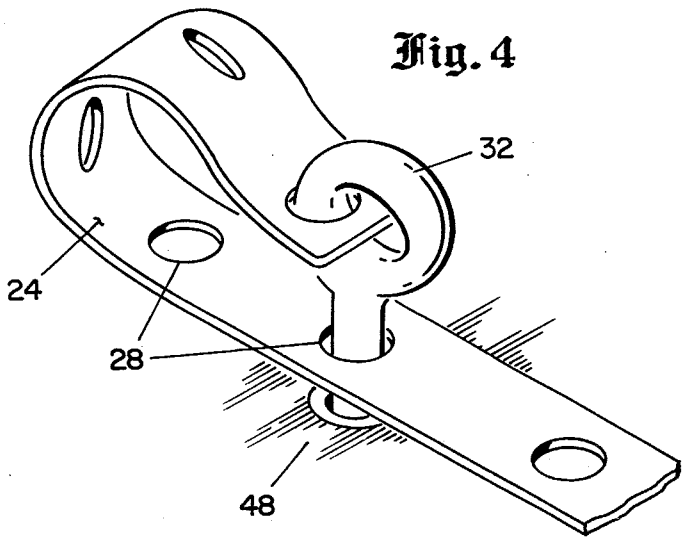
FIG. 4 is a exploded view of the attachment portion of the present invention.

This is more clearly shown in FIG. 4 and 5 wherein the concrete decking 48 is shown in which a hole 46 is dug and a sleeve 50 is placed into the hole dug vertically down into the concrete decking. The sleeve 50 is made of any convenient material such as a metallic steel pipe. The bolt 30 to which the end eyelet of strap 22 is fixedly attached is then slid into sleeve 50 and is sized so that the eye of bolt 30 is located flush with the surface of the ground 52 so that a minimum amount of vertical material is exposed above the ground level 52. The spa lounge 14 is adjusted as to height within the spa 10 by taking the end of bolt 30 and placing it through one of the eyelets 28 of strap 22 and then down into the sleeve 50 and thus into the ground. Thus the strap 22 is folded over to any convenient length desired by the user depending upon how he wants the lounge 14 to be in the spa 10, and depending upon the distance of the sleeve 50 from the spa 10. The eyelets 26 and 28 may be reinforced by any convenient means such as groumets or reinforced sewing to make them last longer.

As stated, when the lounge is in use it can easily be connected by passing one of the bolts 30 through the proper eyelet in straps 22 and 24 adjusting the lounge so that it sits just below the surface of the water 36. The user simply then climbs into the spa and lies down in the lounge. As stated, the turbulent action of the water supports the body in such a way that only a minimum of support is needed to keep the body afloat in the spa. This way the very narrow strips of material that form the lounge allow for a maximum open space between each strip so that a maximum amount of water and turbulence reaches the body of the person using the spa.

As stated, the lounge can be made of any convenient water-resistant material such as vinyl coated material or for even more strength a vinyl coated "Beta Glass" manufactured by Owens Corning. The Beta Glass is a combination of a fiber glass and acrylic fibers.

Having thus described the invention, it is requested that applicant be limited only by the scope of the appended claims.

I claim:

1. A combination of a hot water spa and a lounge mounted therein; said spa having a deck surrounding said spa, said deck having sleeves fitted therein at opposite ends of said spa; said lounge being formed of one piece and comprising a body support portion formed of a series of unitary, narrow longitudinal and transverse strips of water resistant material in a crossed pattern, unitary solid head rests extending from each end of said pattern, and unitary straps extending from said head rests; and bolts attached to said straps which are slidably received in said sleeves.

2. A combination according to claim 1 wherein said strips comprise a vinyl plastic.

3. A combination according to claim 1 wherein said strips comprise a fiber glass, acrylic fiber material.

4. A combination according to claim 1 wherein said sleeves each comprise a metal pipe fitted vertically into said deck.

5. A combination according to claim 1 wherein said deck comprises concrete.

6. A combination according to claim 1 wherein said bolts comprise eyebolts secured in openings in ends of said straps remote from said head rests and said straps have eyelets therein between said head rests and openings through which said eyebolts extend.

7. A combination according to claim 6, wherein at least one of said straps has a plurality of eyelets between its opening and its head rest, whereby the height of said lounge in said spa may be adjusted by positioning its eyebolt in selected ones of said plurality of eyelets.

* * * * *